US010917728B2

(12) United States Patent
Kamijima et al.

(10) Patent No.: US 10,917,728 B2
(45) Date of Patent: Feb. 9, 2021

(54) MEMS MICROPHONE

(71) Applicant: TDK CORPORATION, Tokyo (JP)

(72) Inventors: Akifumi Kamijima, Tokyo (JP); Tohru Inoue, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/509,761

(22) Filed: Jul. 12, 2019

(65) Prior Publication Data

US 2020/0077202 A1 Mar. 5, 2020

(30) Foreign Application Priority Data

Aug. 30, 2018 (JP) ..... 2018-161722

(51) Int. Cl.
*H04R 19/04* (2006.01)

(52) U.S. Cl.
CPC ..... *H04R 19/04* (2013.01); *H04R 2201/003* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,654,468 | B1 | 11/2003 | Thompson | |
| 10,687,149 | B2 * | 6/2020 | Kamijima | H04R 31/00 |
| 2003/0002129 | A1 | 1/2003 | Kobayashi et al. | |
| 2005/0246167 | A1 | 11/2005 | Nakajima et al. | |
| 2006/0280318 | A1 | 12/2006 | Warren et al. | |
| 2008/0205668 | A1 | 8/2008 | Torii et al. | |
| 2009/0181489 | A1 | 7/2009 | Horimoto et al. | |
| 2010/0092020 | A1 | 4/2010 | Ryan et al. | |
| 2012/0039499 | A1 | 2/2012 | Ryan et al. | |
| 2012/0123775 | A1 | 5/2012 | Murgia et al. | |
| 2012/0207334 | A1 | 8/2012 | Ryan et al. | |
| 2012/0288130 | A1 | 11/2012 | Dehe | |
| 2013/0096914 | A1 | 4/2013 | Avendano et al. | |
| 2015/0003638 | A1 | 1/2015 | Kasai | |
| 2015/0043759 | A1 | 2/2015 | Koji et al. | |
| 2015/0076627 | A1 | 3/2015 | Johansen et al. | |
| 2015/0129992 | A1 | 5/2015 | Hur et al. | |
| 2016/0277846 | A1 | 9/2016 | Lee | |
| 2016/0345106 | A1 | 11/2016 | Pahl et al. | |

(Continued)

FOREIGN PATENT DOCUMENTS

| | | | |
|---|---|---|---|
| CN | 102811411 | A | 12/2012 |
| JP | 2001-169395 | A | 6/2001 |

(Continued)

*Primary Examiner* — Amir H Etesam
(74) *Attorney, Agent, or Firm* — Oliff PLC

(57) ABSTRACT

A MEMS microphone includes a substrate, and a first conversion portion and a second conversion portion provided on the substrate, the first conversion portion and the second conversion portion convert sound into an electrical signal, the first conversion portion includes a first through hole, a first membrane covering the first through hole, and a first back plate facing the first membrane via a first air gap, the second conversion portion includes a second through hole, a second membrane covering the second through hole, and a second back plate facing the second membrane via a second air gap, and a dimension of the second air gap is greater than a dimension of the first air gap in a thickness direction of the substrate.

8 Claims, 13 Drawing Sheets

(56) References Cited

U.S. PATENT DOCUMENTS

| | | | |
|---|---|---|---|
| 2017/0223455 | A1 | 8/2017 | Conklin et al. |
| 2017/0326591 | A1 | 11/2017 | Apte et al. |
| 2017/0347174 | A1 | 11/2017 | Chandrasekaran et al. |
| 2018/0234751 | A1 | 8/2018 | Lee |

FOREIGN PATENT DOCUMENTS

| | | | |
|---|---|---|---|
| JP | 2006-005710 | A | 1/2006 |
| JP | 2007-104562 | A | 4/2007 |
| JP | 2007-295487 | A | 11/2007 |
| JP | 2008-245267 | A | 10/2008 |
| JP | 2011-055087 | A | 3/2011 |
| JP | 2012-506211 | A | 3/2012 |
| JP | 2013-183164 | A | 9/2013 |
| JP | 2015-502693 | A | 1/2015 |
| JP | 2015-035730 | A | 2/2015 |
| JP | 2017-509195 | A | 3/2017 |
| WO | 2004/021031 | A1 | 3/2004 |
| WO | 2013/168868 | A1 | 11/2013 |

* cited by examiner

MEMS MICROPHONE

CROSS-REFERENCE TO RELATED APPLICATIONS

This application is based upon and claims the benefit of priority from Japanese Patent Application No. 2018-161722, filed on 30 Aug. 2018, the entire contents of which are incorporated herein by reference.

TECHNICAL FIELD

The present disclosure relates to a MEMS microphone.

BACKGROUND

In recent years, demand for an ultra-small microphone module including a MEMS microphone has increased. For example, Japanese Unexamined Patent Publication No. 2011-055087 (Patent Document 1), Japanese Unexamined Patent Publication. No. 2015-502693 (Patent Document 2), and Japanese Unexamined Patent Publication No. 2007-295487 (Patent Document 3) disclose a MEMS microphone having a configuration in which a membrane and a back plate are disposed to face each other via an air gap on a silicon substrate. In such a MEMS microphone, a capacitor structure is formed of the membrane and the back plate. When a sound pressure is received and the membrane vibrates, the capacitance in the capacitor structure changes. The change in capacitance is converted to an electrical signal and amplified in an ASIC chip.

SUMMARY

Incidentally a sound pressure level (that is, a dynamic range) that the above-described MEMS microphone can handle is limited. As a result of intensive research, the inventors have found a new technology for expanding a dynamic range of the MEMS microphone.

According to the present disclosure, a MEMS microphone capable of expanding a dynamic range is provided.

A MEMS microphone according to an aspect of the present disclosure includes a substrate; and a first conversion portion and a second conversion portion provided on the substrate, the first conversion portion and the second conversion portion convert sound into an electrical signal, wherein the first conversion portion includes a first through hole penetrating the substrate; a first membrane covering the first through hole on one surface side of the substrate; and a first back plate covering the first through hole on the one surface side of the substrate, the first back plate faces the first membrane via a first air gap, wherein the second conversion portion includes a second through hole penetrating the substrate; a second membrane covering the second through hole on one surface side of the substrate; and a second back plate covering the second through hole on the one surface side of the substrate, the second back plate faces the second membrane via a second air gap, and a dimension of the second air gap is greater than a dimension of the first air gap in a thickness direction of the substrate.

This MEMS microphone includes the first conversion portion and the second conversion portion, and the dimension of the second air gap in the second conversion portion is greater than that of the first air gap in the first conversion portion in the thickness direction of the substrate. Thus, the dimension of the second air gap becomes greater than the dimension of the first air gap. Accordingly, when a high sound pressure level is input, it is possible to cope with the input in the second conversion portion in which it is difficult for the second membrane and the second back plate to come into contact with each other. Accordingly, it is possible to cope with a wide range of sound pressure level with both the first conversion portion and the second conversion portion, and to achieve expansion of a dynamic range of the MEMS microphone.

In the MEMS microphone according to another aspect, the dimension of the second air gap is 1.1 times or more and 2.0 times or less the dimension of the first air gap in the thickness direction of the substrate. In this configuration, contact between the second membrane and the second back plate is suppressed in the second conversion portion. Therefore, it is possible to cope with a high sound pressure level with the second conversion portion and to achieve expansion of a dynamic range of the MEMS microphone.

In the MEMS microphone according to another aspect, the first conversion portion may include a contact suppression portion suppressing contact between the first membrane and the first back plate. With this configuration, since the contact between the first membrane and the first back plate is suppressed, it is possible to suppress deterioration in characteristics in the first conversion portion.

A MEMS microphone according to an aspect of the present disclosure includes a substrate having a through hole; a membrane covering the through hole on one surface side of the substrate; a first back plate covering the through hole on the one surface side of the substrate, the first back plate faces the membrane via a first air gap; and a second back plate provided on the opposite side of the first back plate with respect to the membrane, the second back plate covers the through hole on the one surface side of the substrate, and the second back plate faces the membrane via a second air gap, wherein a dimension of the second air gap is greater than a dimension of the first air gap in a thickness direction of the substrate.

In this MEMS microphone, the dimension of the second air gap is greater than the dimension of the first air gap in the thickness direction of the substrate. Accordingly, even when a high sound pressure level is input, contact between the membrane and the second hack plate is suppressed. Therefore, it is possible to cope with a high sound pressure level with the capacitor structure configured of the membrane and the second back plate and to achieve expansion of a dynamic range of the MEMS microphone.

In the MEMS microphone according to another aspect, the dimension of the second air gap is 1.1 times or more and 2.0 times or less the dimension of the first air gap in the thickness direction of the substrate. In this configuration, contact between the membrane and the second hack plate is suppressed. Therefore, it is possible to cope with a high sound pressure level with the capacitor structure configured of the membrane and the second back plate and to achieve expansion of a dynamic range of the MEMS microphone.

The first back plate of the MEMS microphone according to another aspect may include a contact suppression portion suppressing contact between the membrane and the first back plate. With this configuration, since the contact between the membrane and the first back plate is suppressed, it is possible to suppress deterioration in characteristics in a capacitor structure configured of the membrane and the first back plate.

DETAILED DESCRIPTION

Figure 1:
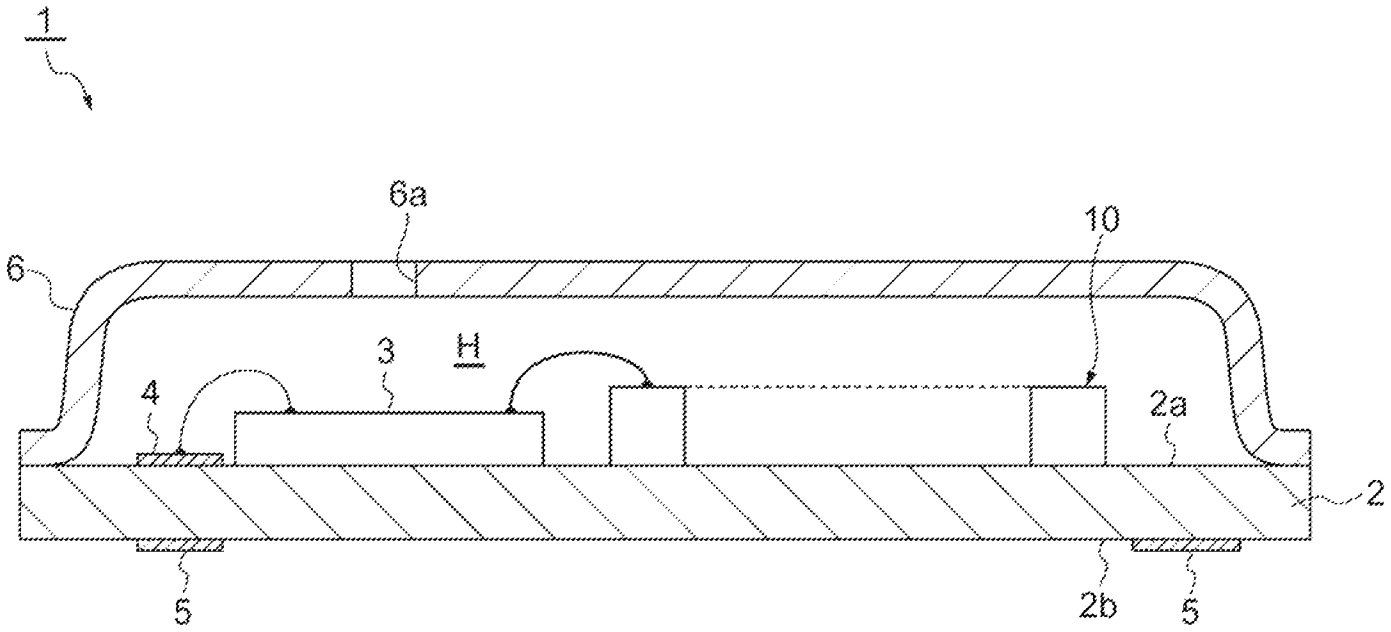
FIG. 1 is a schematic cross-sectional view illustrating a microphone module according to an embodiment.

Hereinafter, various embodiments will be described in detail with reference to the drawings. It should be noted that in the drawings, the same or corresponding portions are denoted by the same reference numerals and redundant description will be omitted.

As illustrated in FIG. 1, a microphone module 1 according to the embodiment includes at least a module substrate 2, a control circuit chip 3 (ASIC), a cap 6, and a MEMS microphone 10.

The module substrate 2 has a flat outer shape and is made of, for example, a ceramic material. The module substrate 2 may have a single-layer structure or a multi-layer structure including internal wirings. Terminal electrodes 4 and 5 are provided on one surface 2*a* and the other surface 2*b* of the module substrate 2, respectively, and the terminal electrodes 4 and 5 are connected to each other via a through conductor or internal wirings (not illustrated).

The cap 6 forms a hollow structure on the upper surface 20*a* side of the substrate 20 to be described below. Specifically, the cap 6 defines a cavity H between the cap 6 and the substrate 20, and the MEMS microphone 10 and the control circuit chip 3 are accommodated inside the cavity H. In the embodiment, the cap 6 is a metal cap made of a metal material. A sound hole 6*a* connecting the outside to the cavity H is provided in the cap 6.

Figure 2:
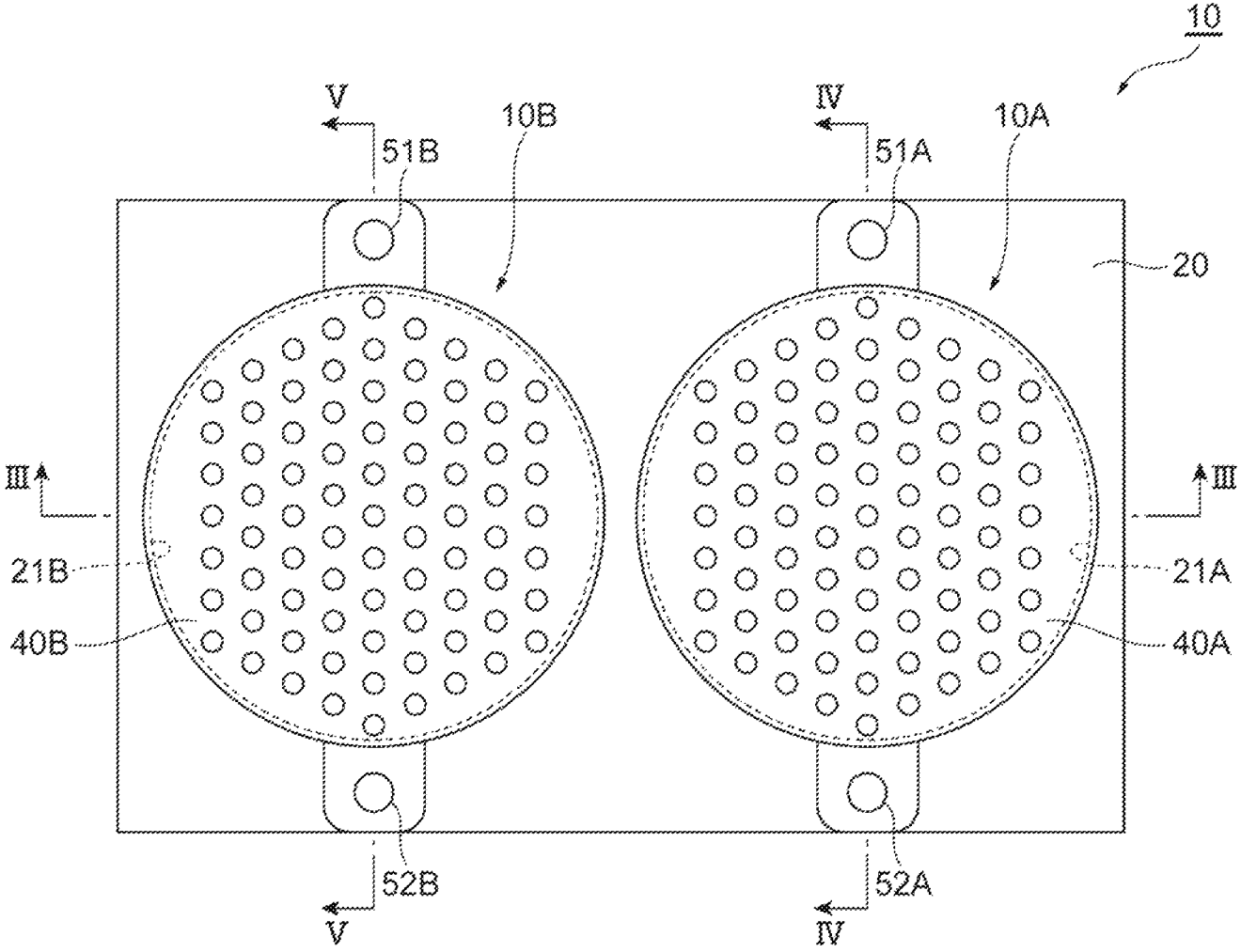
FIG. 2 is a plan view of the MEMS microphone illustrated in FIG. 1.
Figure 3:
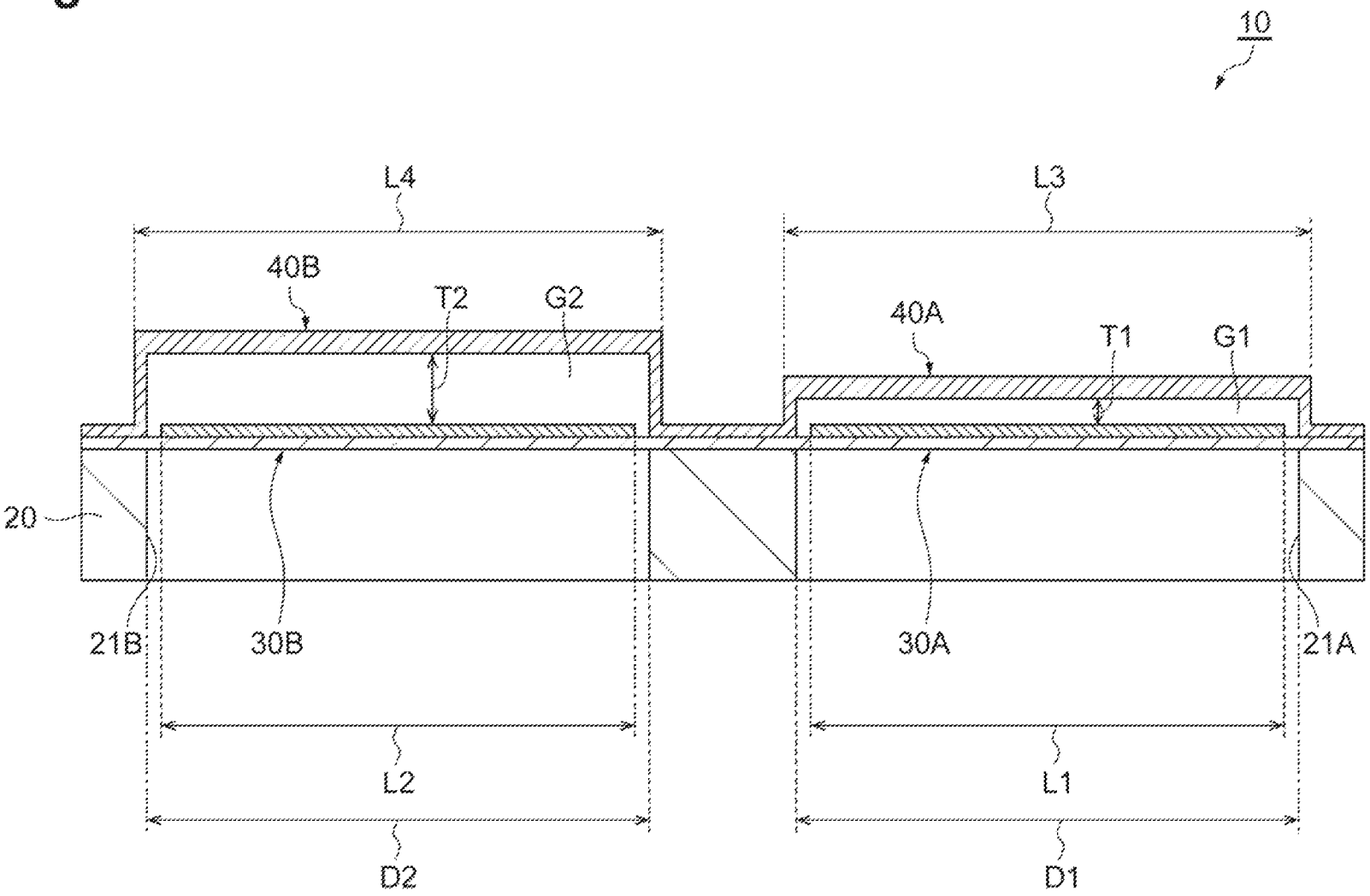
FIG. 3 is a cross-sectional view taken along a line III-III in FIG. 2.

The MEMS microphone 10 is mounted on the one surface 2*a* of the module substrate 2. The MEMS microphone 10 has a configuration in which a portion of the MEMS microphone 10 vibrates when the MEMS microphone 10 receives a sound pressure. As illustrated in FIGS. 2 and 3, the MEMS microphone 10 includes at least a first conversion portion 10A, a second conversion portion 10B, and a substrate 20.

The substrate 20 is made of for example, Si or quartz glass ($SiO_2$). In the embodiment, the substrate 20 is made of glass which contains silicate as a main component and does not substantially contain alkali metal oxides. The substrate 20 has a rectangular flat outer shape. A thickness of the substrate 20 is, for example, 500 μm. The substrate 20 can have a substantially rectangular shape (for example, 1500 μm×3000 μm) in a plan view, as illustrated in FIG, 2.

Figure 4:
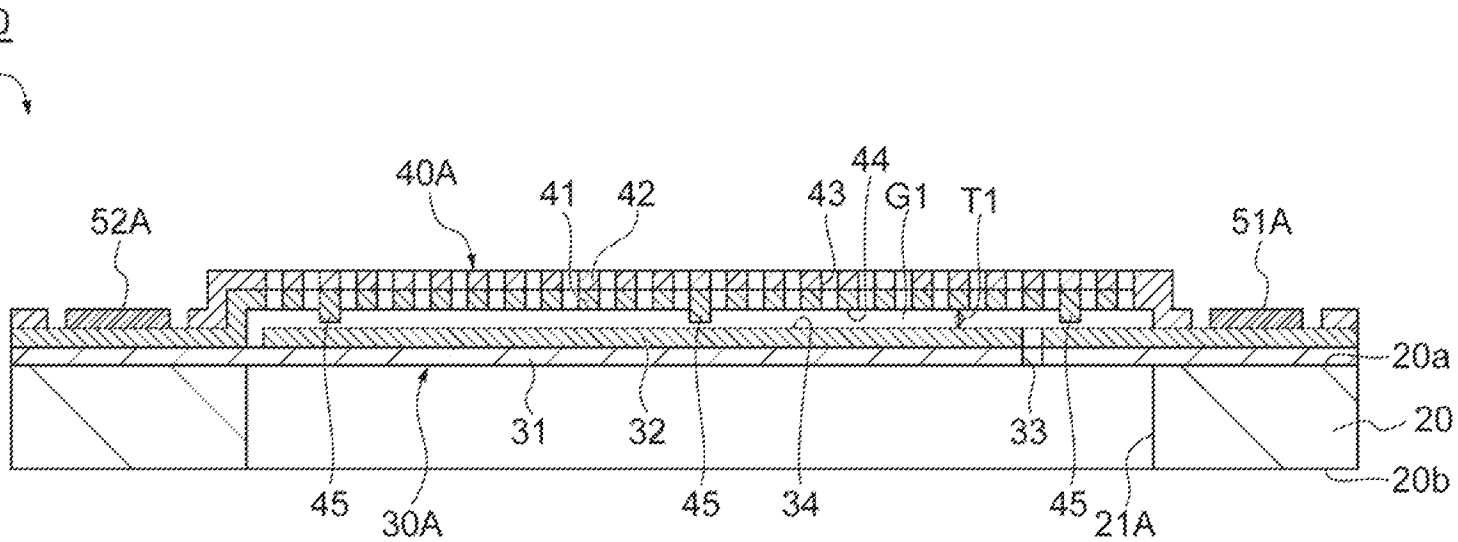
FIG. 4 is a cross-sectional view taken along a line IV-IV of FIG. 2.

As illustrated in FIG. 4. the first conversion portion 10A includes a first through hole 21A, a first membrane 30A, a first back plate 40A, and a pair of terminal portions 51A and 52A. The first through hole 21A has, for example, a true circular shape in plan view (that is, when viewed from a thickness direction of the substrate 20). A diameter D1 of the first through hole 21A is, for example, 1000 μm. The first membrane 30A is also referred to as a diaphragm and is a membrane that vibrates according to a sound pressure. The first membrane 30A is located on the upper surface 20*a* side that is one surface side of the substrate 20, and is directly laminated on the upper surface 20*a*. The first membrane 30A is provided to cover the entire first through hole 21A of the substrate 20.

The first membrane 30A has a multi-layer structure, and has a two-layer structure in the embodiment. A first layer 31 of the first membrane 30A located on the lower side is made of an insulator material (SiN in the embodiment). A thickness of the first layer 31 is, for example, 200 nm. The first layer 31 is provided on the upper surface 20*a* of the substrate 20 including the first through hole 21A. A second layer 32 of the first membrane 30A located on the upper side is made of a conductive material (Cr in the embodiment). A thickness of the second layer 32 is, for example, 100 nm. The second layer 32 is integrally provided in a region corresponding to the first through hole 21A of the substrate 20 and an edge region of the first through hole 21A, which is a region in which the one (the terminal portion 51A in the embodiment) of the pair of terminal portions 51A and 52A has been formed.

When the first through hole 21A of the substrate 20 is completely closed by the first membrane 30A, a pressure difference may occur between the side above and the side below the first membrane 30A. In order to reduce such a pressure difference, a small through hole 33 is provided in the first membrane 30A in the embodiment. It should be noted that a plurality of through holes 33 may be provided in the first membrane 30A.

The first back plate 40A is located on the upper surface 20*a* side of the substrate 20 and is located on the side above the first membrane 30A. The first back plate 40A is provided to cover the entire first through hole 21A of the substrate 20, similar to the first membrane 30A. The first back plate 40A faces the first membrane 30A is a first air gap G1. More specifically, a facing surface 11 (a lower surface in FIG. 4) of the first back plate 40A faces a facing surface 34 (an upper surface in FIG. 4) of the first membrane 30A in a region in which the first through hole 21A of the substrate 20 has been formed.

The first back plate 40A has a multi-layer structure, and has a two-layer structure in the embodiment, similar to the first membrane 30A. A first layer 41 of the first hack plate 40A located on the lower side is made of a conductive material (Cr in the embodiment). A thickness of the first layer 41 is, for example, 300 nm. A second layer 42 of the first back plate 40A located on the upper side is made of an insulator material (SiN in the embodiment). A thickness of the second layer 42 is, for example, 50 nm. The first layer 41 and the second layer 42 of the first back plate 40A are integrally provided in the region corresponding to the first through hole 21A of the substrate 20 and the edge region of the first through hole 21A, which is a region in which the other (the terminal portion 52A in the embodiment) of the pair of terminal portions 51A and 52A has been formed. The second layer 42 of the first back plate 40A is not provided in a region in which the pair of terminal portions 51A and 52A have been formed, and the second layer 32 of the first membrane 30A and the first layer 41 of the first back plate 40A are exposed in the region in which the pair of terminal portions 51A and 52A have been formed. The first back plate 40A includes a plurality of holes 43. The plurality of holes 43 may all have, for example, a true circular opening shape (see FIG. 2) and may be regularly disposed (staggered in the embodiment).

The pair of terminal portions 51A and 52A are made of a conductive material and is made of Cu in the embodiment. One terminal portion 51A among the pair of terminal portions 51A and 52A is formed on the second layer 32 of the first membrane 30A provided in the edge region of the first through hole 21A, and the other terminal portion 52A is formed on the first layer 41 of the first hack plate 40A provided in the edge region of the first through hole 21A.

The first conversion portion 10A includes a contact suppression portion 45 that suppresses contact between the first membrane 30A and the first back plate 40A. In the embodiment, the contact suppression portion 45 is a protrusion provided on the facing surface 44 side of the first back plate 40A. The contact suppression portions 45 are provided in a series on the first layer 41 of the first back plate 40A, and extend toward the first membrane 30A. By providing the contact suppression portions 45 in this manner, it is possible to suppress a phenomenon (so-called sticking) in which the first membrane 30A and the first back plate 40A come into contact with and do not separate from each other.

In the first conversion portion 10A, the first membrane 10A includes the second layer 32 as a conductive layer, and the first back plate 40A includes the first layer 41 as a conductive layer, as described above. Therefore, in the first conversion portion 10A, a parallel flat plate type capacitor structure is formed of the first membrane 30A and the first back plate 40A. When the first membrane 30A vibrates according to a sound pressure, a width of the first air gap G1 between the first membrane 30A and the first back plate 40A changes and a capacitance of the capacitor structure changes. The first conversion portion 10A is a capacitive conversion portion that outputs change in capacitance from the pair of terminal portions 51A and 52A.

Figure 5:
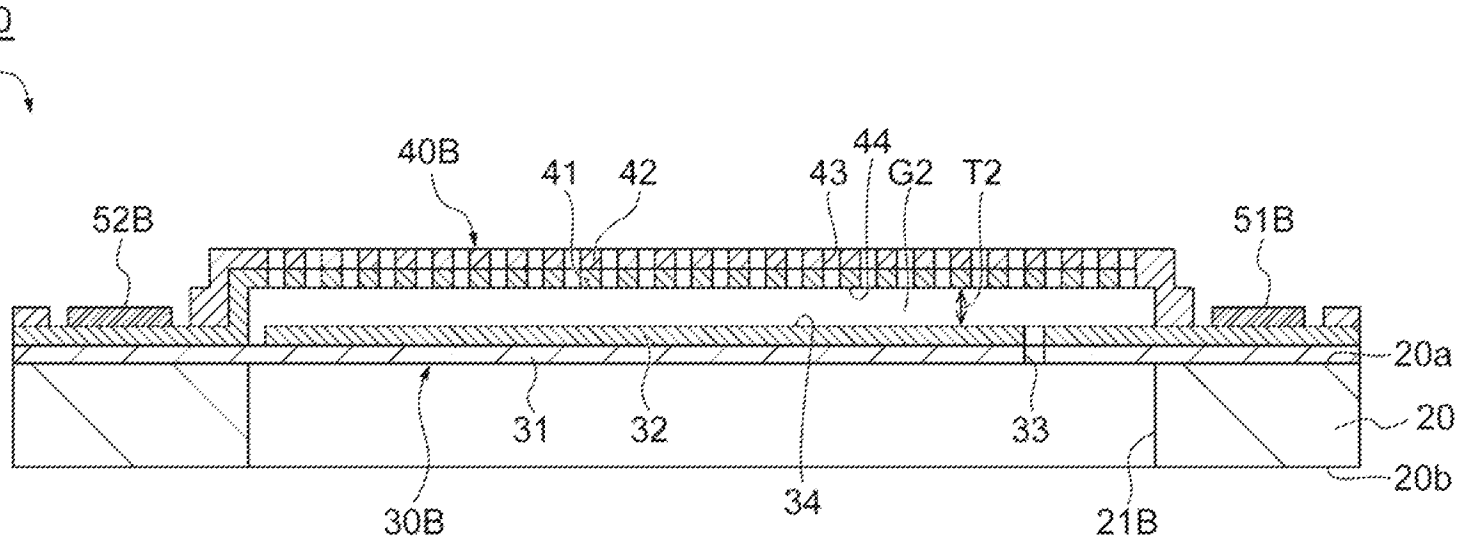
FIG. 5 is a cross-sectional view taken along a line VV of FIG. 2.

The second conversion portion 10B has substantially the same configuration as the first conversion portion 10A, as illustrated in FIG. 5. The second conversion portion 10B is provided on the same substrate 20 as that for the first conversion portion 10A. The second conversion portion 10B is disposed side by side next to the first conversion portions 10A. The second conversion portion 10B includes a second through hole 21B, a second membrane 30B, a second back plate 40B, and a pair of terminal portions 51B and 52B. The second through hole 21B has, for example, a true circular shape in plan view (that is, when viewed from a thickness direction of the substrate 20). A diameter D2 of the second through hole 21B is substantially the same as the diameter D1 of the first through hole 21A and is, for example, 1000 μm. The second membrane 30B is a membrane that vibrates according to a sound pressure, similar to the first membrane 30A. The second membrane 30B is located on the upper surface 20*a* side that is one surface side of the substrate 20, and is directly laminated on the upper surface 20*a*. The second membrane 30B is provided to cover the entire second through hole 21B of the substrate 20.

The second membrane 30B has a multilayer structure, similar to the first membrane 30A. In the embodiment, the second membrane 30B has a two-layer structure including a first layer 31 and a second layer 32. A thickness of the second membrane 30B is substantially the same as that of the first membrane 30A and is, for example, 2000 nm. The second membrane 30B is provided on the upper surface 20*a* of the substrate 20 including the second through hole 21B. The second layer 32 of the second membrane 30B located on the upper side is made of a conductive material (Cr in the embodiment). A thickness of the second layer 32 is, for example, 100 nm. The second layer 32 is integrally provided in a region corresponding to the second through hole 21B of the substrate 20 and an edge region of the second through hole 21B, which is a region in which the one (the terminal portion 52B in the embodiment) of the pair of terminal portions 51B and 52B has been formed. In the second membrane 30B, a through hole 33B is provided to reduce a pressure difference between the side above and the side below the second membrane 30B. It should be noted that a plurality of through holes 33 may be provided in the second membrane 30B.

The second back plate 40B is located on the upper surface 20*a* side of the substrate 20 and is located on the side above the second membrane 30B. The second back plate 40B is provided to cover the entire second through hole 21B of the substrate 20, similar to the second membrane 30B. The second back plate 40B faces the second membrane 30B via a second air gap G2. More specifically, a facing surface 44 (a lower surface in FIG. 5) of the second back plate 40B faces a facing surface 34 (an upper surface in FIG. 4) of the second membrane 30B in a region in which the second through hole 21B of the substrate 20 has been formed.

The second back plate 40B has a multi-layer structure, and has a two-layer structure in the embodiment, similar to the first back plate 40A. A first layer 41 of the second back plate 40B located on the lower side is made of a conductive material (Cr in the embodiment). A thickness of the first layer 41 is, for example, 300 nm. A second layer 42 of the second back plate 40B located on the upper side is made of an insulator material (SiN in the embodiment). A thickness of the second layer 42 is, for example, 50 nm. The first layer 41 and the second layer 42 of the second back plate 40B are integrally provided in a region corresponding to the second through hole 21B of the substrate 20 and an edge region of the second through hole 21B, which is a region in which the other (in the embodiment, the terminal portion 52B of the pair of terminal portions 51B and 52B is formed. The second layer 42 of the second back plate 40B is not provided in the region in which the pair of terminal portions 51B and 52B are formed, and the second layer 32 of the second membrane 30B and the first layer 41 of the second back plate 40B are exposed in the region in which the pair of terminal portions 51B and 52B are formed. The second back plate includes a plurality of holes 43. The plurality of holes 43 may all have, for example, a true circular opening shape (see FIG. 2) and may be regularly disposed (staggered in the embodiment).

The pair of terminal portions 51B and 52B of the second conversion portion 10B are made of a conductive material and is made of Cu in the embodiment. One terminal portion 51B among the pair of terminal portions 51B and 52B is formed on the second layer 32 of the second membrane 50B provided in the edge region o the second through hole 21B, and the other terminal portion 52B is formed on the first layer 41 of the second back plate 40B provided in the edge region of the second through hole 21B.

In the second conversion portion 10B, a parallel flat plate type capacitor structure is formed of the second membrane 30B and the second back plate 40B, similar to the first conversion portion 10A. When the second membrane 30B vibrates according to a sound pressure, a width of the second air gap G2 between the second membrane 30B and the second back plate 40B changes and a capacitance of the capacitor structure changes. The second conversion portion 10B is a capacitive conversion portion that outputs change in capacitance from the pair of terminal portions 51B and 52B.

In the embodiment, an area of the second membrane 30B is substantially the same as an area of the first membrane 30A, and a diameter L2 of the second membrane 30B is also substantially the same as a diameter L1 of the first membrane 30A, as illustrated in FIG. 2. Further, a center of the first membrane 30A and a center of the first back plate 40A are substantially aligned with each other. A center of the second membrane 30B and a center of the second back plate 40B are substantially aligned with each other.

In the thickness direction of the substrate 20, a dimension T2 of the second air gap G2 is greater than a dimension T1 of the first air gap G1 (see FIG. 3). The dimension T2 of the second air gap G2 can be 1.1 times or more and 2.0 times or less the dimension T1 of the first air gap G1 in the thickness direction of the substrate 20. In the embodiment, the dimension T1 of the first air gap G1 is about 2 μm, and the dimension T2 of the second air gap G2 is about 2.6 μm. That is, in the embodiment, the dimension T2 of the second air gap G2 is 1.3 times the dimension T1 of the first air gap G1 in the thickness direction of the substrate 20.

The control circuit chip 3 is mounted on one surface 2*a* of the module substrate 2 to be close to the MEMS microphone 10. A change in capacitance in the MEMS microphone 10 is input to the control circuit chip 3. The control circuit chip 3 and the MEMS microphone 10 are electrically connected by, for example, wire bonding. The control circuit chip 3 is connected to the terminal electrode 4 provided on the one surface 2*a* of the module substrate 2, and a signal of the control circuit chip 3 is output to the outside through the terminal electrodes 4 and 5.

Figure 6:
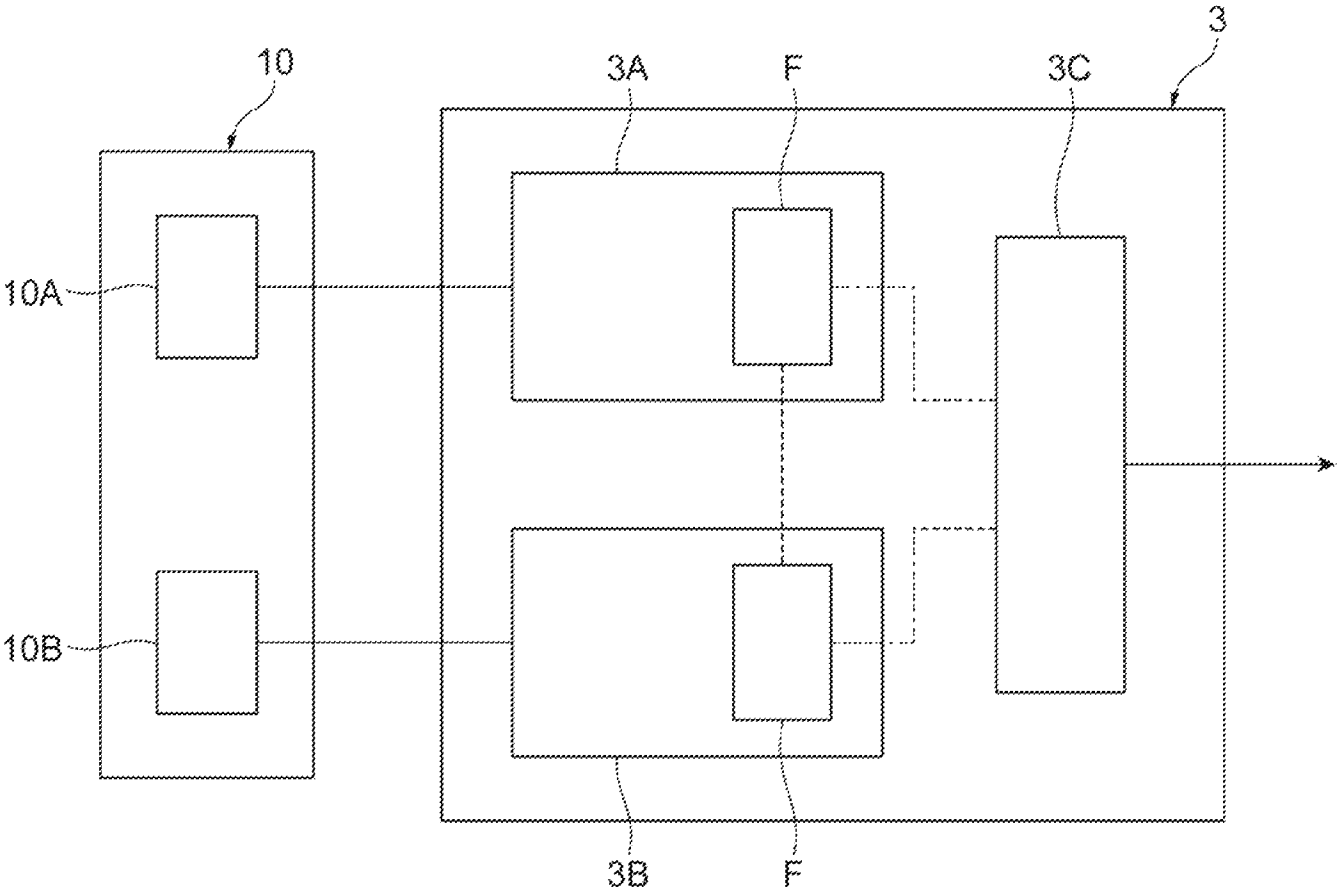
FIG. 6 is a block diagram of a microphone module illustrated in FIG. 1.

As illustrated in FIG. 6, the control circuit chip 3 includes a first control circuit 3A, a second control circuit 3B, and a mixer 3C. The first control circuit 3A is electrically connected to the first conversion portion 10A of the MEMS microphone 10. The second control circuit 3B is electrically connected to the second conversion portion 10B of the MEMS microphone 10. That is, the change in capacitance in the first conversion portion 10A is input, to the first control circuit 3A, and the change in capacitance in the second conversion portion 10B is input to the second control circuit 3B. The first control circuit 3A has a function of converting the change in capacitance in the capacitor structure of the first conversion portion 10A into an analog or digital electrical signal, and an amplification function. Similarly, the second control circuit 3B has a function of converting the change in capacitance in the capacitor structure of the second conversion portion 20B into an analog or digital electrical signal, and an amplification function. The mixer 3C is connected to the first control circuit 3A and the second control circuit 3B. Outputs of the first control circuit 3A and the output of the second control circuit 3B are input to the mixer 3C. The mixer 3C combines the output of the first control circuit 3A and the output of the second control circuit 3B, and outputs an electrical signal as an output of the control circuit chip 3.

Next, a configuration of the first control circuit 3A will be described in more detail with reference to FIG. 7. Hereinafter, a case in which the first control circuit 3A converts the change in capacitance in the capacitor structure of the first conversion portion 10A into an analog electrical signal will be described. It should be noted that since a configuration of the second control circuit 3B is the same as that of the first control circuit 3A, description thereof will be omitted.

Figure 7:
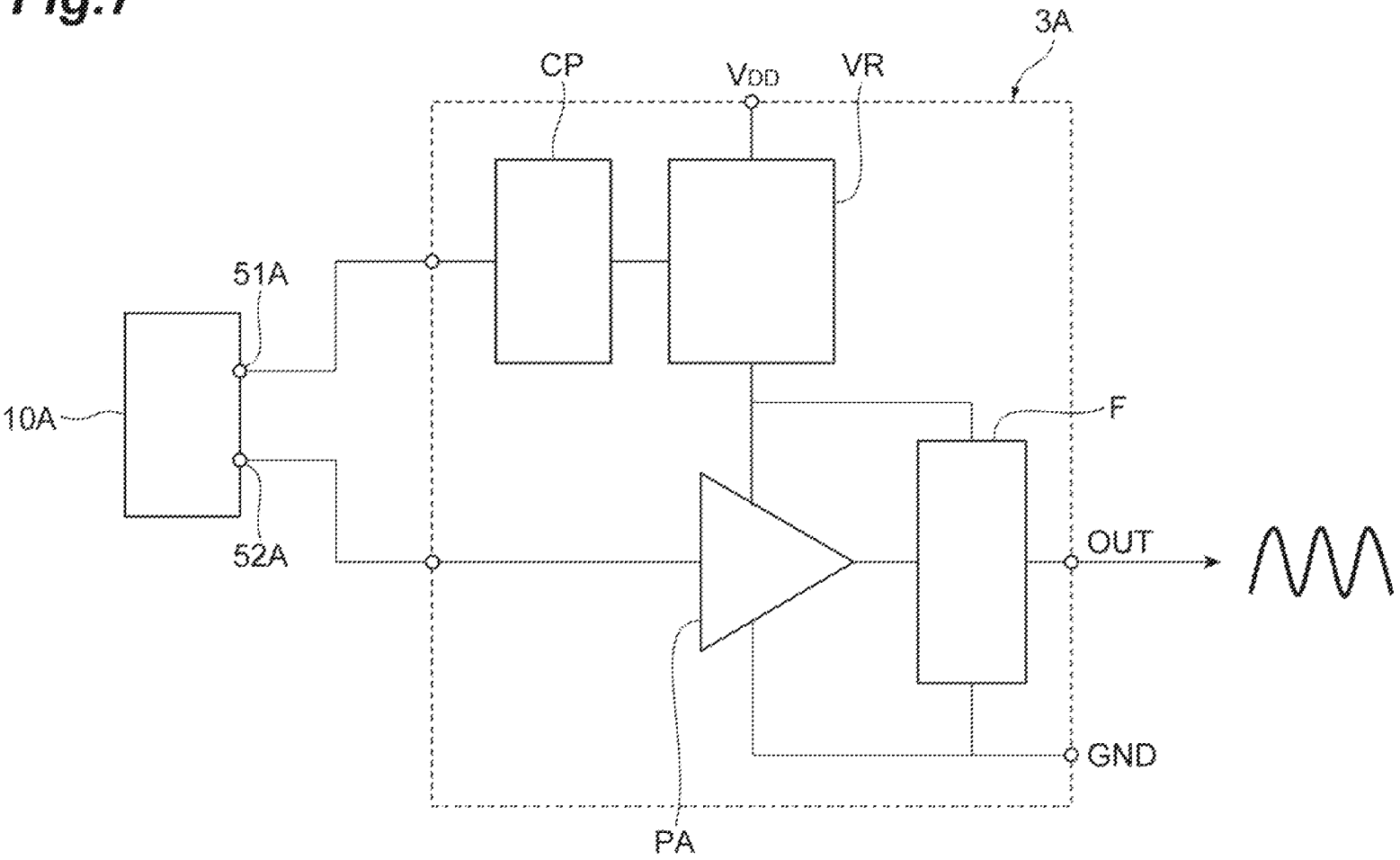
FIG. 7 is a diagram illustrating a configuration of a first control circuit of a control circuit chip illustrated in FIG. 6.

As illustrated in FIG. 7, the first control circuit 3A includes a boosting circuit CP, a reference voltage generation circuit VR, a preamplifier PA, and a filter F. The boosting circuit CP is connected to one terminal portion 51A of the first conversion portion 10A of the MEMS microphone 10, and is a circuit that supplies a bias voltage to the first conversion portion 10A. The reference voltage generation circuit VR is connected to the boosting circuit CP, and generates a reference voltage in the boosting circuit CP. Further, the reference voltage generation circuit VR is also connected to the preamplifier PA and the filter to supply a voltage. The preamplifier PA is connected to the other terminal portion 52A of the first conversion portion 10A, and is a circuit that performs impedance conversion and gain adjustment with respect to the change in capacitance in the capacitor structure of the first conversion portion 10A. The filter F is connected to a stage after the preamplifier PA. The filter F is a circuit that passes only a component in a predetermined frequency band of a signal from the preamplifier PA. Each of the first control circuit 3A and the second control circuit 3B has the filter F, and the filter F of the first control circuit 3A and the filter F of the second control circuit 3B are connected to each other (see FIG. 6).

It should be noted that When the first control circuit 3A converts the change in capacitance in the capacitor structure of the first conversion portion 10A into a digital electrical signal, the first control circuit 3A further includes a modulator between the preamplifier PA and the filter F. This modulator converts an analog signal from the preamplifier PA into a pulse density modulation (PDM) signal.

The control circuit chip 3 performs switching between the first conversion portion 10A and the second conversion portion 10B according to the sound pressure level of a sound wave detected by the MEMS microphone 10. Specifically, when the sound pressure level is equal to or lower than a predetermined threshold value, the control circuit chip 3 outputs a signal based on the change in capacitance in the first conversion portion 10A (that is, a signal output from the first control circuit 3A). When the sound pressure level is higher than the predetermined threshold value, the control circuit chip 3 outputs a signal based on the change in capacitance in the second conversion portion 10B (that is, a signal output from the second control circuit 3B). As an example, the threshold value of the sound pressure level in the control circuit chip 3 can be a value in a range of 100 dB or more and 120 dB or less. It should be noted that the threshold value may be appropriately set according to the dimension T1 of the first air gap G1 of the first conversion portion 10A and the dimension T2 of the second air gap G2 of the second conversion portion 10B in the thickness direction of the substrate 20.

It should be noted that the control circuit chip 3 may per the switching on the basis of two threshold values (a first threshold value on the low sound pressure level side and a second threshold value on the high sound pressure level side) for the sound pressure level. For example, when the sound pressure level is equal to or lower than the first threshold value, the control circuit chip 3 may output a signal based on the change in capacitance in the first conversion portion 10A (that is, the signal output from the first control circuit 3A). When the sound pressure level is higher than the first threshold value and lower than the second threshold value, the control circuit chip 3 combines the signal based on the change in capacitance in the first conversion portion 10A with the signal based on the change in capacitance in the second conversion portion 10B using the mixer 3C and outputs a resultant signal. When the sound pressure level is equal to or higher than the second threshold value, the control circuit chip 3 outputs a signal based on the change in capacitance in the second conversion portion 10B (that is, the signal output from the second control circuit 3B).

Next, a procedure for manufacturing the above-described MEMS microphone 10 will be described with reference to FIGS. 8A to 8C and 9A to 9C. It should be noted that since the first conversion portion 10A and the second conversion portion 10B have substantially the same structure, and are formed together with the same operations. Therefore, only cross-sections in the first conversion portion 10A are shown in FIGS. 8A to 8C and 9A to 9C.

Figure 8A:
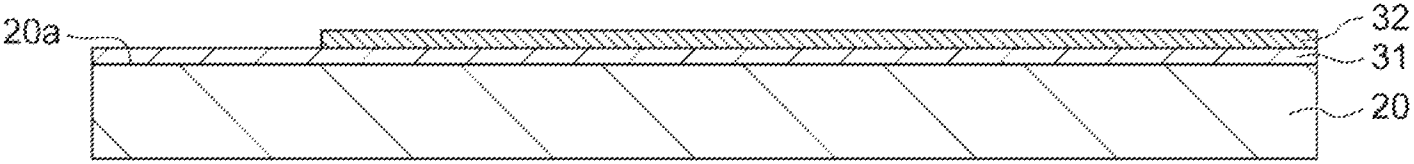
FIGS. 8A to 8C are diagrams illustrating respective steps when the MEMS microphone illustrated in FIG. 2 is manufactured.

When the MEMS microphone 10 is manufactured, the first layer 31 and the second layer 32 of the first membrane 30A are first sequentially formed on the upper surface 20*a* of the flat substrate 20 in which the first through hole 21 A is not formed, as illustrated in FIG. 8A. The first layer 31 can be formed using CVD of an insulating material (SiN in the embodiment). The second layer 32 is formed using sputtering of a conductive material (Cr in the embodiment). The first layer 31 and the second layer 32 can be patterned using: a photoresist and RIE (not illustrated).

Figure 8B:
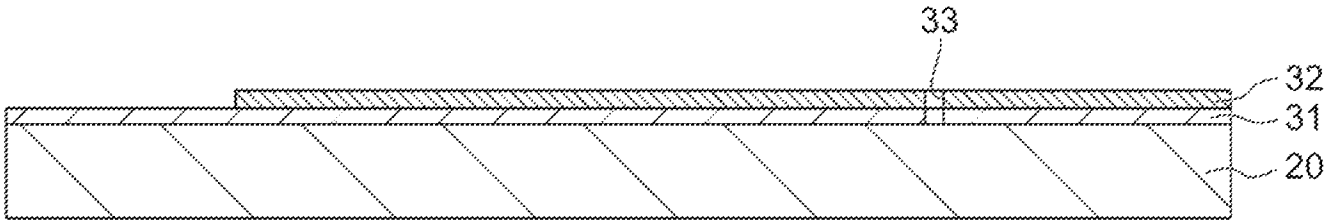
Figure 8C:
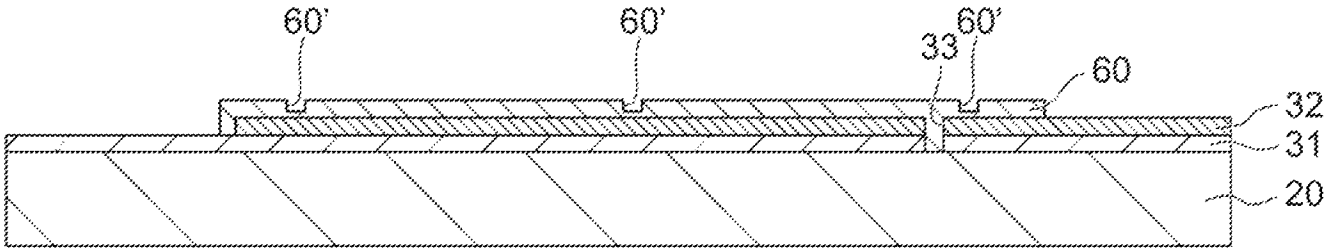

Then, the through hole 33 is provided in the first membrane 30A, as illustrated in FIG. 8B. The through hole 33 can be formed, for example, using RIE using a photoresist having an opening in a region of the through hole 33. A type of gas used for RIE is appropriately selected according to a material of a layer constituting the first membrane 30A.

Further, a sacrificial layer 60 is formed in a region serving as the first air gap G1 described above, as illustrated in FIG. 8C. The sacrificial layer 60 is formed, for example, using CVD of $SiO_2$. A thickness of the sacrificial layer 60 is, for example, 2 μm. Recesses 60' are formed in the sacrificial layer 60 at places corresponding to the contact suppression portion 45 to be formed below. The sacrificial layer 60 can be patterned using photoresist and RIE (not illustrated).

Figure 9A:
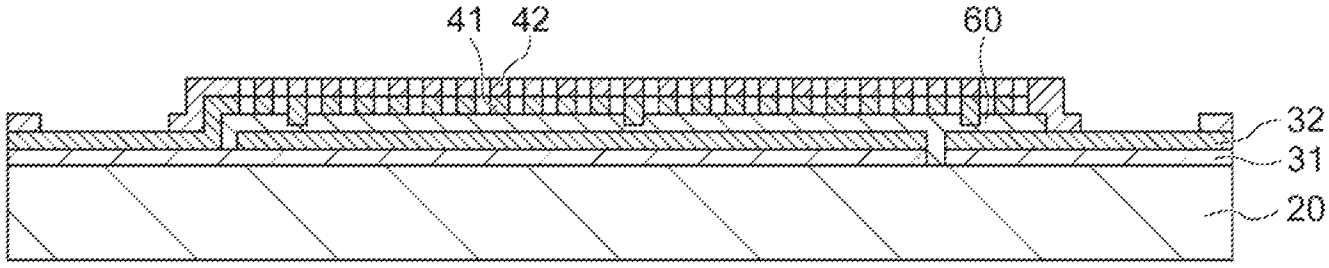
FIGS. 9A to 9C are diagrams illustrating respective steps when the MEMS microphone illustrated in FIG. 2 is manufactured.

Next, the first layer 41 and the second layer 42 of the first back plate 40A are sequentially deposited, as illustrated in FIG. 9A. Accordingly, the first back plate 40A is formed, and the contact suppression portion 45 is formed at a place corresponding to the recess 6' of the sacrificial layer 60. The first layer 41 is formed using sputtering of a conductive material (Cr in the embodiment). The second layer 42 is formed using CVD of an insulator material (SiN in the embodiment). The first layer 41 and the second hoer 42 can be patterned using a photoresist and RIE (not illustrated).

Figure 9B:
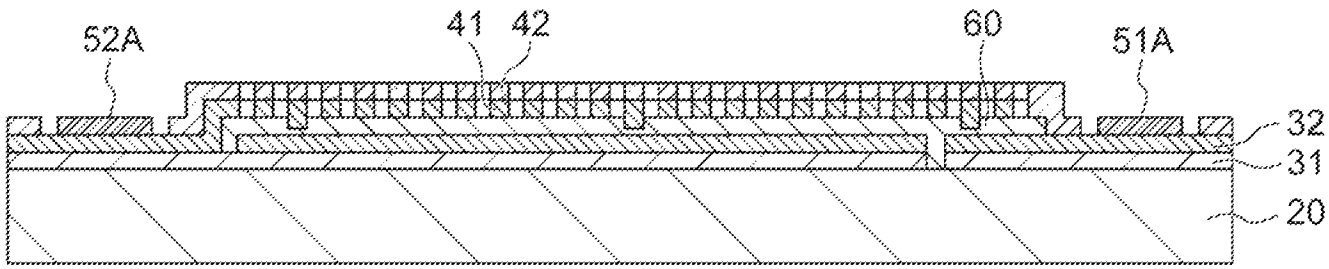

Further, the pair of terminal portions 51A and 52A are formed, as illustrated in FIG. 9B. Specifically, the terminal portion 51A is formed on the second layer 32 of the first membrane 30A, and the terminal portion 52A is formed on the first layer 41 of the first back plate 40A. The terminal portions 51A and 52A are formed using sputtering of a conductive material (Cu in the embodiment). The terminal portions 51A and 52A can be patterned using a photoresist and RIE (not illustrated).

Figure 9C:
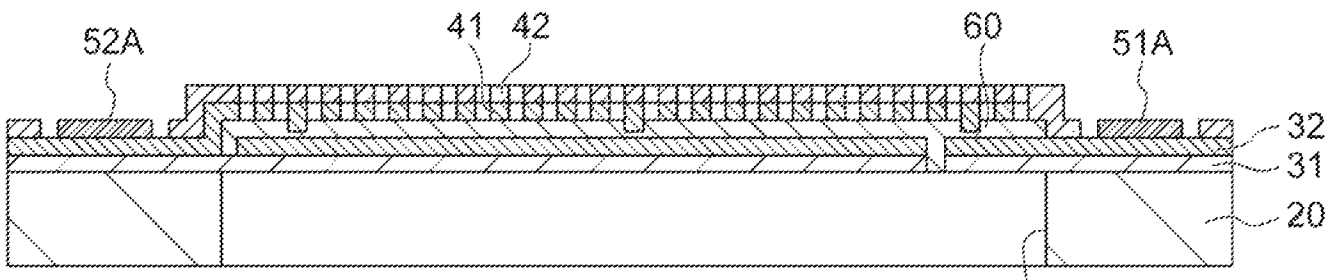

Further, as illustrated in FIG. 9C, the first through hole 21A is formed in the substrate 20 by etching. The first through hole 21A is formed by wet etching using buffered hydrofluoric acid (BHF). The first through hole 21A can also be formed by dry etching using hydrogen fluoride (HF) vapor. At the time of etching, the entire upper surface 20*a* of the substrate 20 and the lower surface 20*b* other than a region in which the first through hole 21A is formed are covered with a photoresist or the like. In addition, an SiN layer having a thickness of about 50 nm may be formed on the upper surface 20*a* (on the side below the first membrane) of the substrate 20 as an etching stopper film. After the first through hole 21A is formed, a portion of the SiN layer exposed from the first through hole 21A may be removed by etching.

The sacrificial layer 60 is removed by etching. The sacrificial layer 60 is removed by wet etching using buffered hydrofluoric acid (BHF). The sacrificial layer 60 can also be removed by dry etching using hydrogen fluoride (HF) vapor. At the time of etching, the upper surface 20*a* of the substrate 20 other than the region in which the sacrificial layer 60 is formed and the entire lower surface 20*b* are covered with a photoresist or the like. The MEMS microphone 10 described above is manufactured by the above-described procedure.

As described above, the MEMS microphone 10 includes the first conversion portion 10A and the second conversion portion 10B, and the dimension T2 of the second air gap G2 in the second conversion portion 10B is greater than the dimension T1 of the first air gap G1 in the first conversion portion 10A in the thickness direction of the substrate 20. Generally, when a size of the air gap is small, sensitivity to a low sound pressure level is good, but it is easy for contact between the membrane and the back plate to occur for a high sound pressure level, and total harmonic distortion (THD) tends to increase. Therefore, it is easy for sound breaking to occur for a high sound pressure level. On the other hand, when the size of the air gap is large, the sensitivity to a low sound pressure level decreases, but it is difficult for contact to occur and it is difficult for THD to increase since the membrane and the back plate are separated. In particular, it is difficult for sound breaking to occur for a high sound pressure level.

Figure 10:
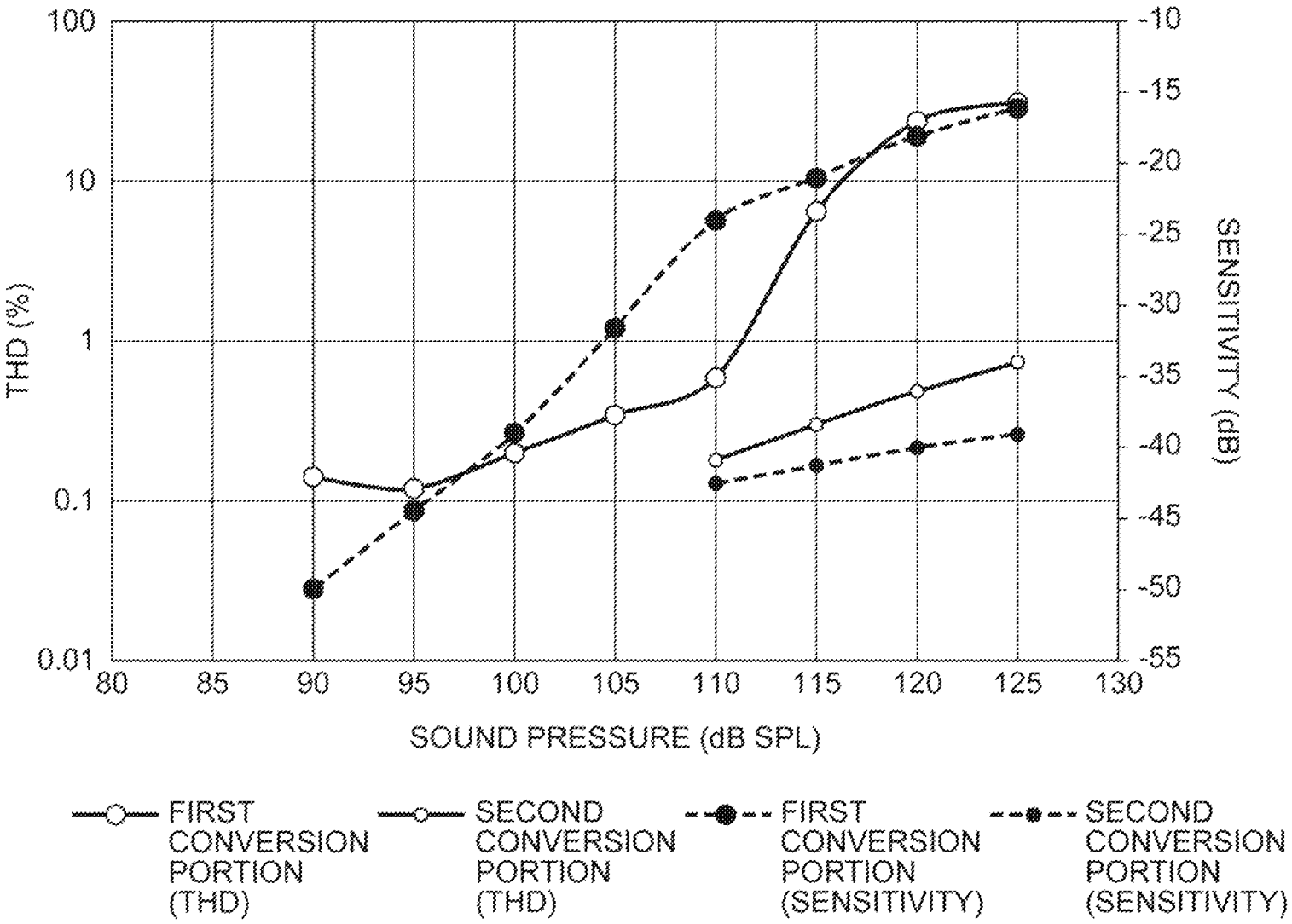
FIG. 10 is a graph illustrating characteristics of the MEMS microphone illustrated in FIG. 2 with respect to a sound pressure level.

FIG. 10 is a graph illustrating a relationship between the sound pressure level and THD in the first conversion portion 10A and the second conversion portion 10B of the MEMS microphone 10, and a relationship between the sound pressure level and the sensitivity. A vertical axis on the left side of the graph of FIG. 10 indicates a proportion of the THD, and a vertical axis on the right side of the graph of FIG. 10 indicates the sensitivity to the input sound pressure level. As illustrated in FIG. 10, in a region in which the input sound pressure level is 110 dB or less, the sensitivity of the first conversion portion 10A is good, and a value of the THD is a good value of 1% or less. On the other hand, in a region in which the input sound pressure level is greater than 110 dB, a value for the THD which is better than that in the first conversion portion 10A is obtained in the second conversion portion 10B. Therefore, it is possible to obtain good sensitivity and a good value for the THD for a wide range of sound pressure level, for example, by setting a threshold value of the sound pressure level at which switching between the first conversion portion 10A and the second conversion portion 10B occurs to about 110 dB.

Thus, in the MEWS microphone 10, the dimension T2 of the second air gap G2 becomes greater than the dimension T1 of the first air gap G1. Accordingly, when a high sound pressure level is input, it is possible to cope with the input in the second conversion portion 10B in which it is difficult for the second membrane 30B and the second back plate 40B to come into contact with each other. Accordingly, it is possible to cope with, a wide range of sound pressure level with both the first conversion portion 10A and the second conversion portion 10B. Thus, in the MEMS microphone 10, good sensitivity and THD can be obtained by the first conversion portion 10A with respect to an input at a low sound pressure level, and good sensitivity and THD can be obtained by the second conversion portion 10B with respect to an input at a high sound pressure level. Therefore, it is possible to achieve expansion of the dynamic range of the MEMS microphone 10.

Further, in the MEMS microphone, the dimension T2 of the second air gap G2 is 1.1 times or more and 2.0 times or less the dimension T1 of the first air gap G1 in the thickness direction of the substrate 20. In this case, the contact between the second membrane 30B and the second back plate 40B is suppressed in the second conversion portion 10B. Therefore, it is possible to cope with a high sound pressure level with the second conversion portion 10B, and to achieve expansion of the dynamic range of the MEMS microphone 10.

Further, in the MEMS microphone 10, the first conversion portion 10A includes the contact suppression portion 45 that suppresses the contact between the first membrane 30A and the first back plate 40A. Accordingly, since the contact between the first membrane 30A and the first back plate 40A is suppressed, it is possible to suppress deterioration in characteristics in the first conversion portion 10A.

Further, in the MEMS microphone 10, the substrate 20 made of glass is used as a substrate. The substrate 20 made of glass includes a higher insulation resistance than a semiconductor substrate such as a silicon substrate. That is, in the MEMS microphone 10, high insulation is realized by the substrate 20 made of glass.

Here, a silicon substrate that is inferior in insulation to the substrate 20 made of glass can be regarded as an incomplete nonconductor, and unintended stray capacitance can be generated between the conductor layers (the second layer 32 of the first membrane 30A and the second membrane 30B, the first layer 41 of the first back plate 40A and the second back plate 40B, and the terminal portions 51A, 52A, 51B and 52B) formed on the substrate. Further even when an insulating thin film (a silicon oxide thin film in the case of a silicon substrate) is provided between the silicon substrate and the conductor layer to enhance insulation of the substrate, stray capacitance can be generated in the insulating thin film. Therefore, in a case in which a silicon substrate is used, terminals are additionally provided in the silicon substrate, and it is necessary to perform potential adjustment between the silicon substrate and the conductive layer using an ASIC.

On the other hand, in the substrate 20 made of glass having high insulation resistance, generation of such stray capacitance is effectively suppressed. Therefore, according to the MEMS microphone 10, it is possible to reduce the stray capacitance by using the substrate 20 made of glass and to suppress noise due to the stray capacitance. Further, according to the MEMS microphone 10, it is not necessary for an insulating thin film to be provided between the substrate 20 and the conductor layer. Further, according to the M EMS microphone 10, it is not necessary to perform the potential adjustment by using the substrate 20 made of glass, and it is possible to simplify signal processing or a circuit design in an ASIC as compared with a case in which a silicon substrate is used.

Although the example in which the first conversion portion 10A and the second conversion portion 10B are formed side by side along the upper surface 20*a* of the substrate 20 has been described in the embodiment described above, the first conversion portion 10A and the second conversion portion 10B may be provided to overlap in the thickness direction of the substrate 20. Hereinafter, a MEMS microphone 10' according to a modification example will be described with reference to FIG. 11.

Figure 11:
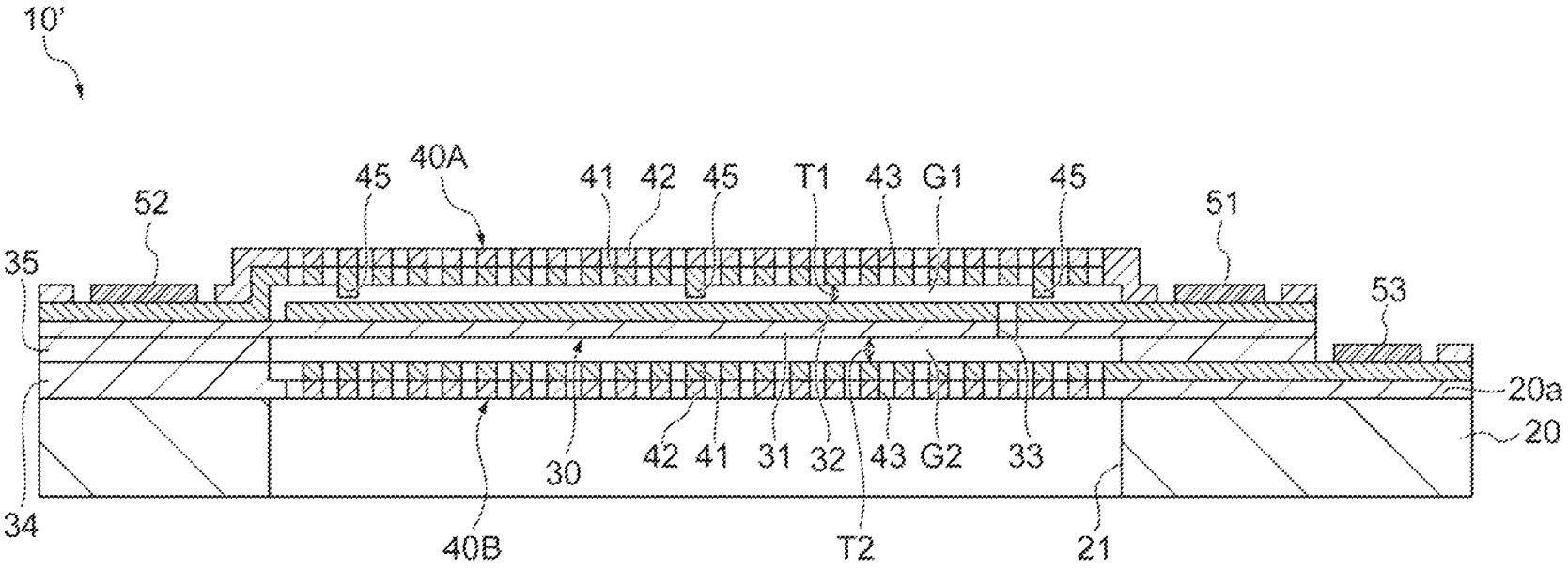
FIG. 11 is a cross-sectional view illustrating a MEMS microphone according to a modification example.

As illustrated in FIG. 11, the MEMS microphone 10' includes a substrate 20 having a through hole 21, a membrane 30 that covers the through hole 21, and a first back plate 40A and a second back plate 40B that face the membrane 30. In the MEMS microphone 10', the two back plates (the first back plate 40A and the second back plate 40B) are provided for the one membrane 30. The second back plate 40B is provided on the opposite side of the first back plate 40A with respect to the membrane 30. That is, the MEMS microphone 10' is different from the MEMS microphone 10 mainly in that the second back plate 40B is interposed between the substrate 20 and the first membrane 30A. The first conversion portion 10A is configured of the membrane 30 and the first back plate 40A, and the second conversion portion 10B is configured of the membrane 30 and the second back plate 40B. The second back plate 40B has a layer structure obtained by turning the first back plate 40A upside down. That is, in the second back plate 40B, a second layer 42 located on the lower side is made of an insulator material (SiN in the embodiment), and a first layer 41 located on the upper side is made of a conductive material (Cr in the embodiment). A terminal portion 53 is formed on the first layer 41 of the second back plate 40B.

In the MEMS microphone 10', the first back plate 40A faces the membrane 30 via the first air gap G1, and the second back plate 40B faces the membrane 30 via the second air gap G2. A dimension T2 of the second air gap G2 between the second back plate 40B and the membrane 30 is greater than a dimension of the first air gap G1 between the first hack plate 40A and the membrane 30.

In the MEMS microphone 10', two parallel flat plate type capacitor structures are formed of the membrane 30 and the two back plates (the first back plate 40A and the second back plate 40B). When the membrane 30 vibrates, a width of the first air gap G1 changes and a width of the second air gap G2 also changes. A change in capacitance of the capacitor structure former of the membrane 30 and the first back plate 40A is output from the terminal portions 51 and 52, and a change in capacitance of the capacitor structure formed of the membrane 30 and the second back plate 40B is output from the terminal portions 51 and 53.

In the MEMS microphone 10', the dimension T2 of the second air gap G2 becomes greater than the dimension T1 of the first air gap G 1 in the thickness direction of the substrate 20. Therefore, expansion of a dynamic range can be achieved, as in the MEMS microphone 10. Further, it is possible to achieve miniaturization of the MEMS microphone 10' by providing the first back plate 40A, the membrane 30, and the second back plate 40B to overlap in the thickness direction of the substrate 20.

Figure 12A:
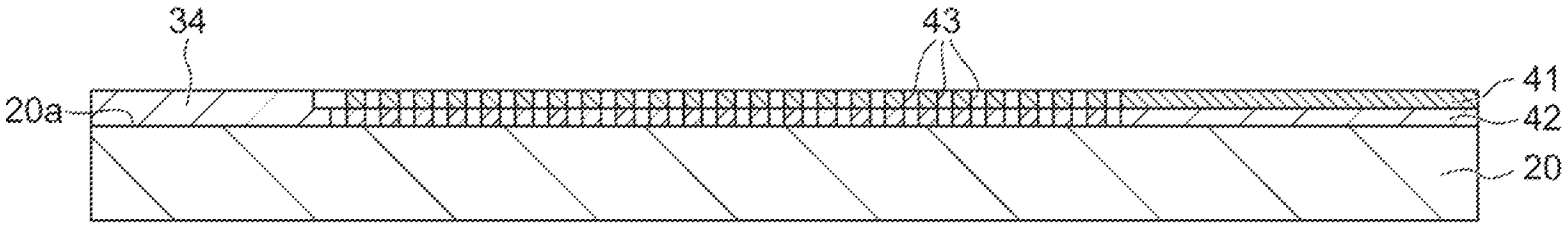
FIGS. 12A to 12C are diagrams illustrating respective steps when the MEMS microphone illustrated in FIG. 11 is manufactured.

Next, a procedure for manufacturing the MEMS microphone 10' will be described with reference to FIGS. 12A to 12C and 13A to 13C. When the MEMS microphone 10' is manufactured, the second layer 42 and the first layer 41 of the second back plate 40B are first sequentially formed on the upper surface 20*a* of the substrate 20 having a flat shape in which the through hole 21 is not formed, as illustrated in FIG. 12A. The first layer 41 is formed using sputtering of a conductive material (Cr in the embodiment). The second layer 42 is formed using CVD of an insulator material (SiN in the embodiment). The first layer 41 and the second layer 42 can be patterned using a photoresist and RIE (not illustrated). It should be noted that, for surface planarization, an insulator film 35 is formed in a remaining region of the region in which the second back plate 40B has been formed. The insulator film 35 is formed using CVD of an insulator material (SiN in the embodiment). The insulator film 35 can also be patterned using a photoresist and RIE (not illustrated).

Figure 12B:
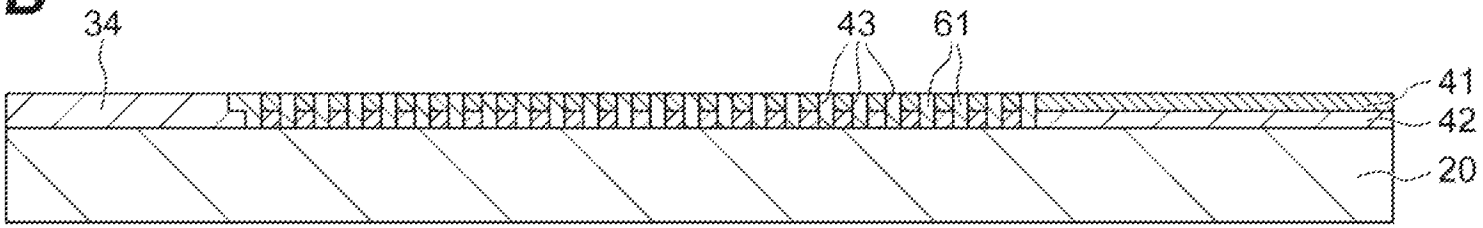
Figure 12C:
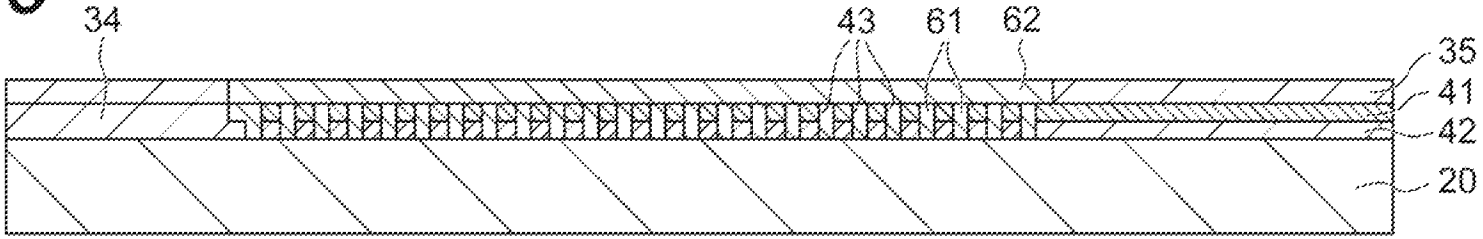

Next, each hole 43 of the second back plate 40B is filled with the insulator 61 ($SiO_2$ in the embodiment), as illustrated in FIG. 12B. The insulator 61 can be obtained by polishing a surface using CMP after $SiO_2$ is deposited using CVD.

Further, a sacrificial layer 62 is formed in a region serving as the second air gap G2 described above, as illustrated in FIG. 12C. The sacrificial layer 62 is formed, for example, using CVD of $SiO_2$. A thickness of the sacrificial layer 62 is, for example, 3 μm. The sacrificial layer 62 can be patterned using photoresist and RIE (not illustrated). It should be noted that, for surface planarization, an insulator film 36 is formed in a remaining region of the region in which the sacrificial layer 62 has been formed. The insulator film 36 is formed using CVD of an insulator material (SiN in the embodiment). The it film 36 can also be patterned using photoresist and RIE (not illustrated). After the sacrificial layer 62 and the insulator film 36 are formed, a surface can be polished using CMP for surface planarization of the sacrificial layer 62 and the insulator film 36.

Figure 13A:
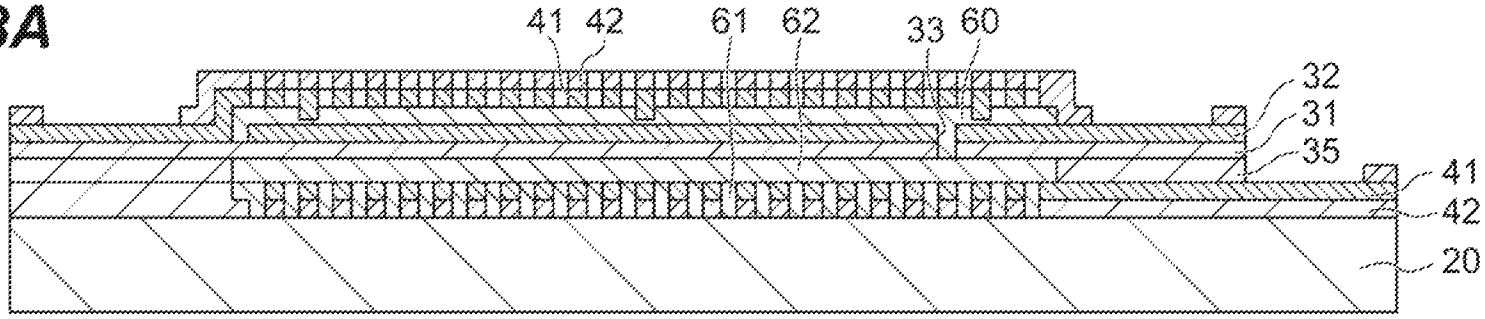
FIGS. 13A to 13C are diagrams illustrating respective steps when the MEMS microphone illustrated in FIG. 11 is manufactured.

A membrane 30 and a first back plate 40A are formed on the sacrificial layer 62 and the insulator film 36, similar to the first membrane 30A and the first back plate 40A of the MEMS microphone 10. After the membrane 30 and the first back plate 40A are formed, the second layer 32 of the membrane 30, the first layer 41 of the first back plate 40A, and the first layer 41 of the second back plate 40B in the region in which the terminal portions 51, 52, and 53 are formed are exposed, as illustrated in FIG. 13A.

Figure 13B:
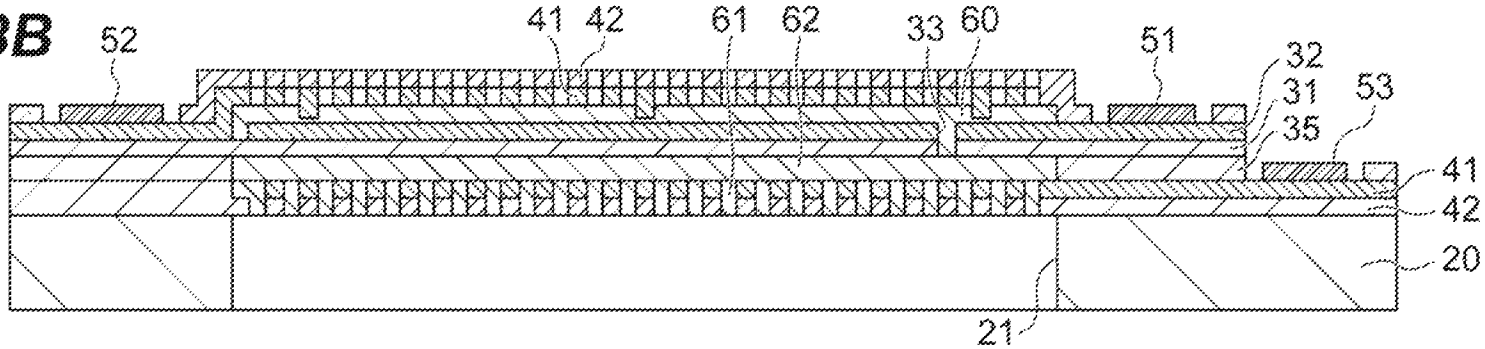

The terminal portions 51, 52, and 53 are formed, as illustrated in FIG. 13B. Specifically, the terminal portion 51 is formed on the second layer 32 of the membrane 30, and the terminals 52 and 53 are formed on the first layer 41 of the first back plate 40A and the second back plate 40B. The terminal portion 53 is formed using sputtering of a conductive material (Cu in the embodiment), similar to the terminal portions 51 and 52. The terminal portions 51, 52, and 53 can be patterned using photoresist and RIE (not illustrated).

Figure 13C:
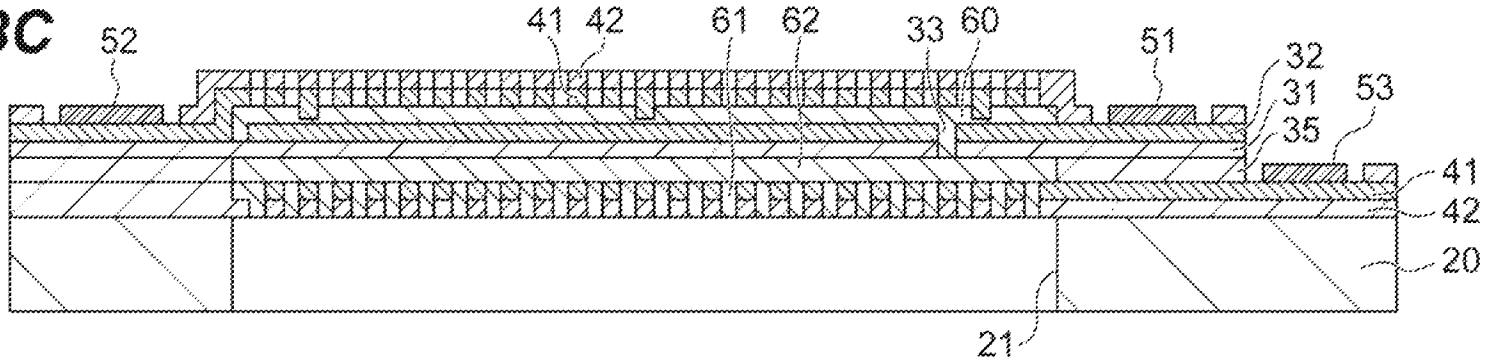

Further, the through hole 21 is formed in the substrate 20 by etching, and the sacrificial layers 60 and 62 and the insulator 61 are removed by etching, as illustrated in FIG. 13C. The sacrificial layers 60 and 62 and the insulator 61 can be removed by wet etching using buffered hydrofluoric acid (BHF) or dry etching using hydrogen fluoride (HF) vapor. The MEMS microphone 10' according to the modification example is manufactured through the procedure described above.

Although the embodiment of the present disclosure has been described above, the present disclosure is not limited to the embodiments, and various modification examples can be made. For example, the membrane may have a single layer structure of a conductor layer rather than a multilayer structure. The back plate may have a single-layer structure of a conductor layer rather than the multi-layer structure. In addition, a stacking order of a conductor layer and a non-conductor layer in the membrane and the back plate can be appropriately changed according to characteristics required for the MEMS microphone.

Although the example in which each of the first conversion portion 10A and the second conversion portion 10B includes one back plate (the first back plate 40A and the second back plate 40B) has been described in the embodiment described above, each of the first conversion portion 10A and the second conversion portion 10B may include two back plates, as illustrated in the MEMS microphone 10'. In this case, since the outputs from the first conversion portion 10A and the second conversion portion 10B become greater than that in the MEMS microphone 10, it is possible to realize a higher SiN ratio than in the MEMS microphone 10 described above.

A conductor material constituting the conductor layer of the membrane and the back plate is not limited to a metal material, and may be another conductive material (for example, phosphorus-doped amorphous silicon).

Although a planar shape of the membrane, the back plate, and the through hole is a circular shape in the above embodiment, the planar shape of the membrane, the back plate, and the through hole may be a polygonal shape or may be a rounded square shape.

Although the example in which only the first conversion portion 10A includes the contact suppression portion 45 that suppresses sticking between the membrane and the hack plate has been described in the embodiment described above, the second conversion portion 10B also includes the contact suppression portion 45.

What is claimed:

1. A MEMS microphone comprising:

a substrate; and a first conversion portion and a second conversion portion provided on the substrate, the first conversion portion and the second conversion portion convert sound into an electrical signal, wherein the first conversion portion includes a first through hole penetrating the substrate;

a first membrane covering the first through hole on one surface side of the substrate; and a first back plate covering the first through hole on the one surface side of the substrate, the first back plate faces the first membrane via a first air gap, wherein the second conversion portion includes a second through hole penetrating the substrate;

a second membrane covering the second through hole on the one surface side of the substrate; and a second back plate covering the second through hole on the one surface side of the substrate, the second back plate faces the second membrane via a second air gap, and a dimension of the second air gap is greater than a dimension of the first air gap in a thickness direction of the substrate.

2. The MEMS microphone according to claim 1, wherein the dimension of the second air gap is 1.1 times or more and 2.0 times or less the dimension of the first air gap in the thickness direction of the substrate.

3. The MEMS microphone according to claim wherein the first conversion portion includes a contact suppression portion suppressing contact between the first membrane and the first back plate.

4. The MEMS microphone according to claim 2, wherein the first conversion portion includes a contact suppression portion suppressing contact between the first membrane and the first back plate.

5. A MEMS microphone comprising:

a substrate having a through hole;

a membrane covering the through hole on one surface side of the substrate;

a first back plate covering the through hole on the one surface side of the substrate, the first back plate faces the membrane via a first air gap; and a second back plate provided on the opposite side of the first back plate with respect to the membrane, the second back plate covers the through hole on the one surface side of the substrate, and the second back plate faces the membrane via a second air gap, wherein a dimension of the second air gap is greater than a dimension of the first air gap in a thickness direction of the substrate.

6. The MEMS microphone according to claim 5, wherein the dimension of the second air gap is 1.1 times or more and 2.0 times or less the dimension of the first air gap in the thickness direction of the substrate.

7. The MEMS microphone according to claim 5, wherein the first back plate includes a contact suppression portion suppressing contact between the membrane and the first back plate.

8. The MEMS microphone according to claim 6, wherein the first back plate has a contact suppression portion suppressing contact between the membrane and the first back plate.

* * * * *